US011078630B2

(12) United States Patent
Zhao et al.

(10) Patent No.: US 11,078,630 B2
(45) Date of Patent: Aug. 3, 2021

(54) MOLDED POMACE PULP PRODUCTS AND METHODS

(71) Applicant: Oregon State University, Corvallis, OR (US)

(72) Inventors: Yanyun Zhao, Beaverton, OR (US); Jooyeoun Jung, Corvallis, OR (US); John Simonsen, Corvallis, OR (US)

(73) Assignee: Oregon State University, Corvallis, OR (US)

( * ) Notice: Subject to any disclaimer, the term of this patent is extended or adjusted under 35 U.S.C. 154(b) by 519 days.

(21) Appl. No.: 15/803,601

(22) Filed: Nov. 3, 2017

(65) Prior Publication Data

US 2018/0119361 A1 May 3, 2018

Related U.S. Application Data

(60) Provisional application No. 62/416,793, filed on Nov. 3, 2016.

(51) Int. Cl.

| | |
|---|---|
| ***D21J 1/00*** | (2006.01) |
| ***D21H 11/12*** | (2006.01) |
| ***D21H 11/14*** | (2006.01) |
| ***D21H 17/24*** | (2006.01) |
| ***D21H 21/06*** | (2006.01) |
| ***D21H 15/10*** | (2006.01) |
| ***D21H 17/23*** | (2006.01) |
| ***D21H 17/25*** | (2006.01) |

(52) U.S. Cl.

CPC ..... *D21J 1/00* (2013.01); *D21H 11/12* (2013.01); *D21H 11/14* (2013.01); *D21H 15/10* (2013.01); *D21H 17/23* (2013.01); *D21H 17/24* (2013.01); *D21H 17/25* (2013.01); *D21H 21/06* (2013.01)

(58) Field of Classification Search

CPC ..... D21J 3/00; D21J 1/00; D21J 7/00; D21H 11/18; D21H 11/12; D21H 11/14; D21H 15/10; D21H 17/02; D21H 17/23; D21H 17/24; D21H 17/25; D21H 21/06

See application file for complete search history.

(56) References Cited

U.S. PATENT DOCUMENTS

| | | | | |
|---|---|---|---|---|
| 4,562,218 | A * | 12/1985 | Fornadel | C04B 28/02 162/142 |
| 5,705,216 | A | 1/1998 | Tyson | |
| 5,759,704 | A | 6/1998 | Horiuchi et al. | |
| 6,468,393 | B1 * | 10/2002 | Small | D21H 27/02 162/134 |
| 6,517,684 | B1 * | 2/2003 | Juul | D21J 7/00 162/226 |
| 7,980,495 | B2 * | 7/2011 | Medoff | B02C 23/14 241/24.19 |
| 8,012,389 | B2 * | 9/2011 | Warnes | B27N 1/00 264/115 |
| 10,428,460 | B2 * | 10/2019 | Hikida | C08B 15/08 |
| 2006/0247336 | A1 | 11/2006 | Medoff et al. | |
| 2015/0005413 | A1 | 1/2015 | Yamazaki et al. | |
| 2015/0337493 | A1 * | 11/2015 | Heiskanen | C08L 1/04 162/9 |
| 2016/0221233 | A1 * | 8/2016 | Kiiskinen | D21H 21/24 |
| 2017/0314201 | A1 * | 11/2017 | Hikida | C08B 15/08 |
| 2018/0119361 | A1 * | 5/2018 | Zhao | D21J 1/00 |
| 2019/0093288 | A1 * | 3/2019 | Mason | D21C 9/18 |
| 2019/0218372 | A1 * | 7/2019 | Nelson | D21B 1/021 |
| 2020/0056333 | A1 * | 2/2020 | Backfolk | D21H 21/16 |
| 2020/0217017 | A1 * | 7/2020 | Shanmuganathan | D21H 17/36 |

FOREIGN PATENT DOCUMENTS

| | | | | |
|---|---|---|---|---|
| EP | 3219848 | B1 * | 7/2019 | D21H 15/02 |
| IN | 244800 | B | 12/2010 | |
| WO | 2011/114101 | A1 | 9/2011 | |
| WO | WO-2015173677 | A1 * | 11/2015 | D21J 3/00 |
| WO | WO-2018207945 | A1 * | 11/2018 | B29C 33/38 |

OTHER PUBLICATIONS

Abdul Khalil, H.P.S., et al., "A Review on Nanocellulosic Fibres as New Material for Sustainable Packaging: Process and Applications," Renewable and Sustainable Energy Reviews 64:823-836, Oct. 2016.

Cotes Palomino, M.T., et al., "Study of the Wet Pomace as an Additive in Ceramic Material," Desalination and Water Treatment 57(6):2712-2718, Feb. 2016.

Fan, M., et al., "Fourier Transform Infrared Spectroscopy for Natural Fibres," in S. Salih (ed.), "Fourier Transform—Materials Analysis," InTech Europe, Rijeka, Croatia, May 2012, Chap. 3, pp. 45-68.

Gardner, D.J., et al., "Adhesion and Surface Issues in Cellulose and Nanocellulose," Journal of Adhesion Science and Technology 22(5-6):545-567, Jan. 2008.

Hirn, U., and R. Schennach, "Comprehensive Analysis of Individual Pulp Fiber Bonds Quantifies the Mechanisms of Fiber Bonding in Paper," Scientific Reports 5:10503, May 2015, pp. 1-9.

Hogarth, C., "Moulded Pulp Packaging," in M.J. Kirwan (ed.), "Paper and Paperboard Packaging Technology," Blackwell Publishing Ltd., Oxford, U.K., 2005, Chap. 14, pp. 414-422.

Jiang, Y., et al., "Compression-Molded Biocomposite Boards From Red and White Wine Grape Pomaces," Journal of Applied Polymer Science 119(5):2834-2846, Mar. 2011.

(Continued)

*Primary Examiner* — Jose A Fortuna

(74) *Attorney, Agent, or Firm* — Christensen O'Connor Johnson Kindness PLLC

(57) ABSTRACT

Composite molded pulp products prepared from fruit or vegetable-based pomace, fibrous paper-based materials, and cellulose nanofiber and methods for preparing the same are provided.

11 Claims, 4 Drawing Sheets
(2 of 4 Drawing Sheet(s) Filed in Color)

(56) References Cited

OTHER PUBLICATIONS

Jung, J., et al., "Impingement Drying for Preparing Dried Apple Pomace Flour and Its Fortification in Bakery and Meat Products," Journal of Food Science Technology 52(9):5568-5578, Sep. 2015.
Park, S.-I., et al., "Feasibility of Creating Compression-Molded Biocomposite Boards From Berry Fruit Pomaces," Journal of Applied Polymer Science 115(1):127-136, Jan. 2010.
Park, S.-I., and Y. Zhao, "Development and Characterization of Edible Films From Cranberry Pomace Extracts," Journal of Food Science 71(2):E95-E101, May 2006.
Siró, I., and D. Plackett, "Microfibrillated Cellulose and New Nanocomposite Materials: A Review," Cellulose 17(3):459-494, Jun. 2010.
Struck, S., et al., "Berry Pomace—A Review of Processing and Chemical Analysis of Its Polyphenols," International Journal of Food Science and Technology 51(6):1305-1318, Jun. 2016.
Twede, D., et al., "Cartons, Crates and Corrugated Board: Handbook of Paper and Wood Packaging Technology," 2d ed., DEStech Publications, Inc., Lancaster, Penn., 2015, Chap. 6.2, "Pulping," pp. 179-190.
Gaikwad, K.K., et al., "Development of Polyvinyl Alcohol and Apple Pomace Bio-Composite Film With Antioxidant Properties for Active Food Packaging Application," Journal of Food Science Technology 53(3)1608-1619, Mar. 2016.

* cited by examiner

Blueberry pomace | Cranberry pomace | Apple pomace
A
Water absorption (%)
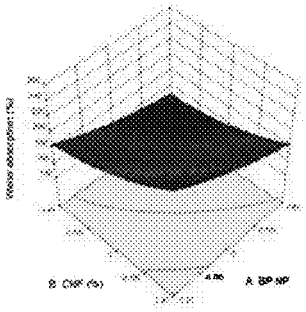
$W_a = 175.10 - 17.03A - 15.96B + 2.83AB + 2.86A^2 + 4.77B^2$
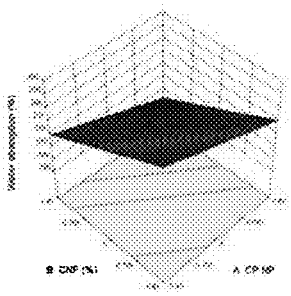
$W_a = 225.21 - 9.79A - 13.59B$
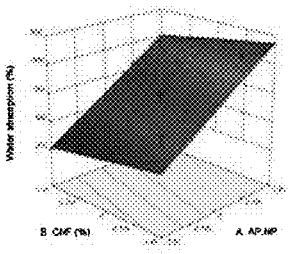
$W_a = 345.79 + 52.51A - 12.04B$
B
Flexural strength (MPa)
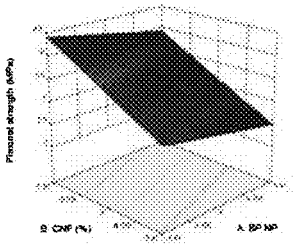
$\sigma_{fM} = 3.45 - 0.17A + 0.51B$
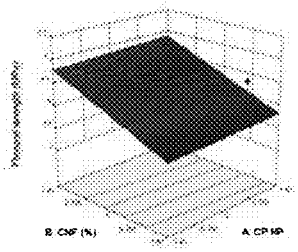
$\sigma_{fM} = 4.31 + 0.038A + 0.38B$
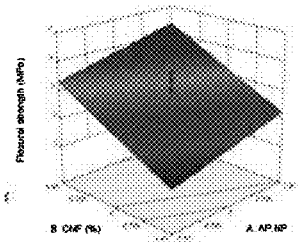
$\sigma_{fM} = 4.78 + 0.38A + 0.76B$
C
Flexural strain(%)
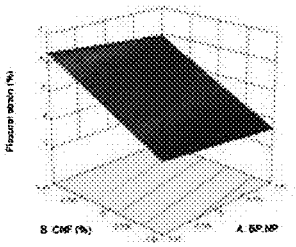
$\epsilon_f = 5.03 - 0.16A + 0.80B$
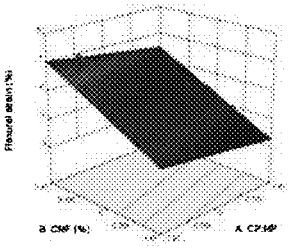
$\epsilon_f = 5.67 - 0.20A + 0.78B$
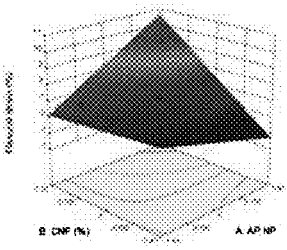
$\epsilon_f = 7.10 + 0.42A + 0.94B + 0.83AB$
*Figs. 2A-2C*

MOLDED POMACE PULP PRODUCTS AND METHODS

FIELD OF THE INVENTION

The present invention is in the fields of composite materials and molded packaging material.

BACKGROUND OF THE INVENTION

Molded pulp packaging materials and products (e.g. egg cartons and coffee cup holders) are made from fiber slurries that normally contain 96% water and 4% fiber from wood pulp or recycled paper (Hogarth, 2005).

Molded pulp has been developed into two major categories, 1) plain molding, which collects fibers from slurry, removes water through implementing vacuum, and then dries the molded pulp in an oven, and 2) precision molding, which utilizes the mold during drying (Hogarth, 2005; Twede, Selke, Kamdem, & Shires, 2014).

Fruit pomace (FP), the byproduct from fruit juice and concentrate processes, contain valuable carbohydrates (e.g. cellulosic fiber) and bioactive compounds. Although some attempts have been made to utilize this byproduct, such as extracting polyphenols (Struck, Plaza, Turner, & Rohm, 2016), incorporating into food products as functional food ingredients (Jung, Cavender, & Zhao, 2014), producing bacterial cellulose as nutrient supplements (Fan et al., 2016), combining with ceramic materials as an additive (Cotes-Palomino, Martínez-García, Iglesias-Godino, Eliche-Quesada, & Corpas-Iglesias, 2016), and creating edible films (Park & Zhao, 2006), only about 20% of generated pomace has been utilized and the majority is used as animal feed or composted to organic matter.

The applicants of the present disclosure previously developed the concept and method to utilize FP powders to create thermally formed biocomposite boards as biodegradable packaging materials, and demonstrated that the fibers in FP had good compatibility with other biodegradable polymers, which prompted our interest in utilizing them as fiber substitutes for paper pulps to create molded pulp packaging. (Jiang, Simonsen, & Zhao, 2011; Park, Jiang, Simonsen, & Zhao, 2010).

Cellulose nanofiber (CNF) contains both crystalline and amorphous regions with a dimension of 10-40 nm in width and an aspect ratio between 100-150 (Khalil et al., 2016; Siró & Plackett, 2010). CNF may enhance the adhesion properties due to its high surface area for improving the interfacial compatibility between fibers in a composite (Gardner et al., 2008). The adhesion property (e.g. interdiffusion, mechanical interlocking, capillary forces, Coulomb forces, hydrogen bonding, and van der Waals forces) of cellulose has been recognized for its use in fiber-based composite materials (Gardner, Oporto, Mills, & Samir, 2008; Hirn & Schennach, 2015).

SUMMARY OF THE INVENTION

In one aspect, disclosed herein are composite molded pulp products and packaging materials comprising (a) a pulp component, wherein the pulp component comprises from about 50% to about 100% fibrous fruit or vegetable pomace by weight and from about 0% to about 50% fibrous paper-based material by weight, (b) a cellulose nanofiber, and optionally (c) one or more additives, such as hydrophobic agents, plasticizers, crosslinking agents, and stabilizers.

In another aspect, a method of making a composite molded pulp product is provided. The method comprises preparing a pulp slurry by grinding or blending together a fibrous fruit pomace and a fibrous paper-based material, in the presence of water, to provide a mixed pulp slurry; adding into the mixed pulp slurry an amount of cellulose nanofiber and optionally additives (plasticizer, crosslinking agent, stabilizer, and/or hydrophobic agent) to provide a pre-molded composite slurry with approximately 2.5% to about 10.0% solids; molding for a time the pre-molded composite slurry into a desired shape to provide a wet composite molded pulp product, wherein the molding includes a pulp forming time and a separate dwelling time; drying the wet composite molded product at a drying temperature sufficient to provide a composite molded product.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

FIG. 2A presents three-dimensional plots of water absorption (%) as related to fruit pomace/newspaper pulp ratio (FP/NP) (A) and cellulose nanofiber concentration (B).

FIG. 2B presents three-dimensional plots of flexural strength (MPa) as related to fruit pomace/newspaper pulp ratio (FP/NP) (A) and cellulose nanofiber concentration (B).

FIG. 2C presents three-dimensional plots of flexural strain (%) as related to fruit pomace/newspaper pulp ratio (FP/NP) (A) and cellulose nanofiber concentration (B).

DETAILED DESCRIPTION OF THE INVENTION

Figures 1A, 1B, 1C:
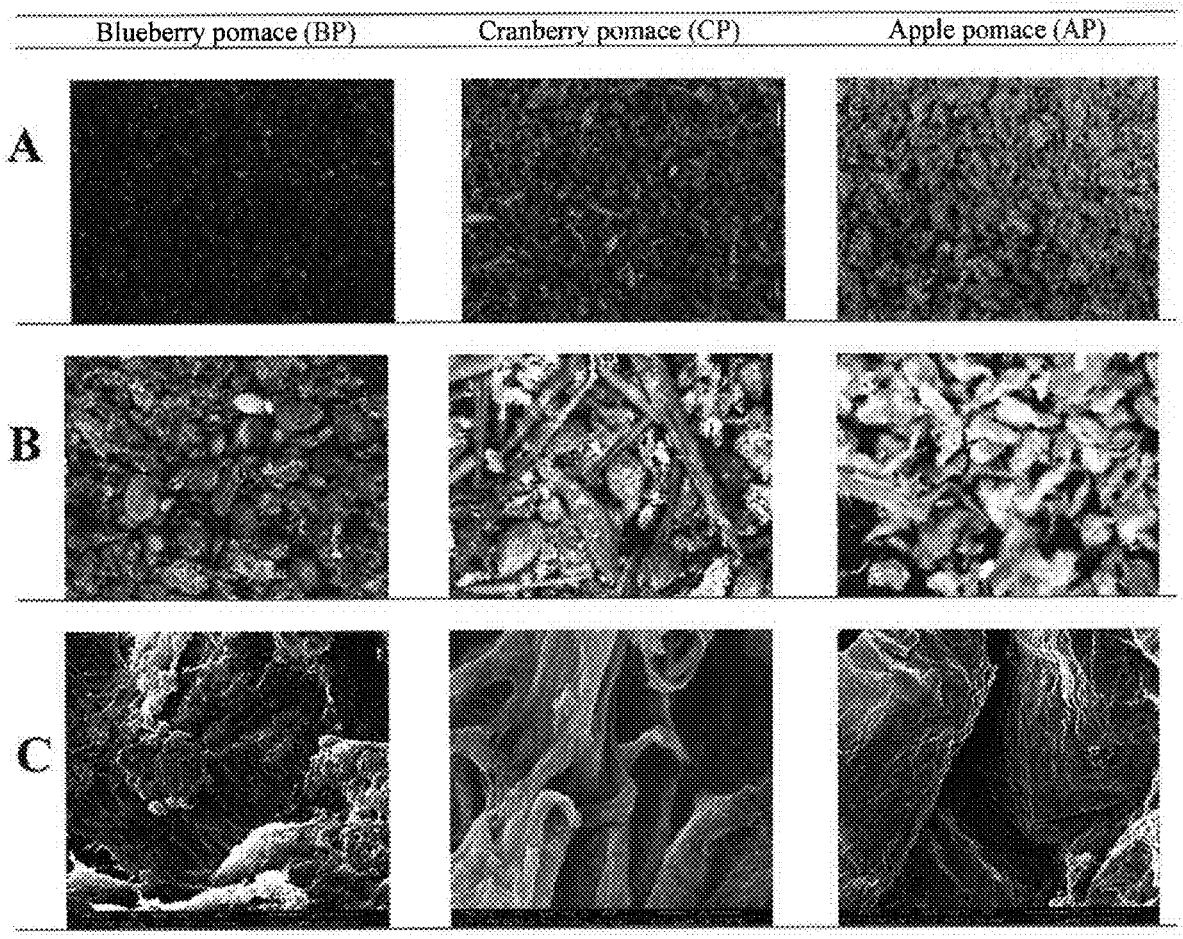
FIG. 1A are images demonstrating color and appearance of wet fruit pomaces (blueberry, cranberry, and apple).
FIG. 1B are images of insoluble fiber compositions of fruit pomaces (blueberry, cranberry, and apple) observed by stereomicroscope. The stereomicroscope images were taken at a 4× magnification.
FIG. 1C are images of the fiber morphologies of fruit pomaces (blueberry, cranberry, and apple) observed by scanning electron microscopy (SEM). The SEM images were collected at a magnification of 1 μm (blueberry and cranberry pomaces) and 20 μm (apple pomace) with an accelerating voltage of 5-10 kV.

The applicants of the present disclosure recognized a need in the art for alternative and improved molded pulp packaging materials and products that do not rely on, or at least reduce the reliance on, the availability of wood pulp, recycled paper, or other fibrous paper-based materials.

Production of products that utilize recycled fibers often rely fibrous paper-based materials such as 50% clean old newspapers (ONP) or cardboard as a fiber source. Products such as floral containers, nursery and greenhouse pots, egg cartons, and molded fiber packaging inserts can be made from fibrous paper-based materials; however, a reduction in the demand for newsprint materials has led to shortages in supply to support the use of fibrous paper-based materials in recycled fiber products. Furthermore, fibrous paper-based products may be water soluble, which restricts their usage.

The price of global wood pulp, the raw material for creating the molded pulp packages, has been continually increasing. Furthermore, the current technological advances in electronics have significantly reduced paper print that consequently deepened the shortage of available recycled newspapers.

As used herein, the term "fibrous fruit or vegetable pomace" refers to the solid remains of fruit or vegetables, for example, grapes, apples, or other fruit, after pressing to remove juice or oil. The terms "fibrous fruit or vegetable pomace" and "fruit pomace," abbreviated as FP, are used interchangeably. FP contains the skins, pulp, seeds, and stems of the fruit. Unlike lees, fruit pomace does not refer to the solids that precipitate from pressed juice or vegetables upon removal of seeds and skins.

As used herein, the phrase "fibrous paper-based material" is meant to have a broad meaning that encompasses both paper material, such as recycled newspaper or cardboard, and wood derived materials such as wood pulp that may be useful in making paper products or traditional molded pulp products. The phrase "fibrous paper-based material" may be used interchangeably with "fibrous wood-derived lignocellulosic material." In some embodiments, fibrous paper based material is newspaper pulp (NP), for example, derived from recycled newspapers.

As used herein, "cellulose nanofiber," abbreviated as CNF, means cellulose fiber with a dimension of about 3 nm to about 100 nm in width and an aspect ratio usually greater than about 50 and that contains both crystalline and amorphous regions. In certain embodiments, CNF is a cellulose fiber with dimension of about 10-40 nm in width and an aspect ratio between about 100-150 and that contains both crystalline and amorphous regions.

In the disclosure that follows, the applicant's present invention is described with reference to any figures, in which any like numerals represent the same or similar elements, and sequence listings. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings. Various aspects, characteristics, components, and methods of preparing or enhancing the various embodiments of the present disclosure that are described for one embodiment are generally intended to potentially be applied to other embodiments, unless stated otherwise.

Composite Molded Pulp Products

In some embodiments, the present disclosure demonstrates that fruit pomace (FP) may partially or wholly substitute for fibrous paper-based material, e.g., NP in molded pulp packaging materials and products. In embodiments, the ability of FP to substitute at least partially for NP may be due to physical (entanglement) and chemical (hydrogen bonds, van der Waals forces, etc.) interactions between their fibers. In embodiments, the present disclosure further demonstrates that the inclusion of CNF in molded pulp products enhances the interfacial compatibility between fibers due to its high flexibility and surface area, and improves the physicochemical and mechanical properties of FP-NP molded pulp packaging products. In embodiments, FP provides good adhesion properties in molded pulp packaging due to its high amount of cellulosic fibers.

In certain embodiments, the present disclosure demonstrates (1) the compatibility of different types of FP fibers with NP fibers, (2) the reinforcement capability of CNF for improving bonding ability between FP and NP fibers, (3) FP-combined-NP composite molded pulp products, such as FP-combined-NP boards (FPBs), that have advantageous water resistant and mechanical properties in comparison with 100% NP board (NPB), and (4) the interactive mechanisms among FP, CNF, and NP on the quality characteristics of FPBs.

The applicants of the present disclosure explored three different exemplary types of FP, namely blueberry, cranberry, and apple pomace, which were selected by considering their distinguished chemical compositions and fiber characteristics. The applicant's discoveries provide new insights into the different FP fiber characteristics, and their compatibility with NP fiber and CNF for creating FPBs, and results would not only enhance the innovative utilizations of FP by creating high value products, but also benefit the society by reducing environmental pollution through the sustainable production of industrial products.

In some embodiments, the present invention relates to molded pulp products that are composites of fibrous fruit or vegetable pomace and fibrous paper-based material, and that also include minor amounts of cellulose nanofiber and optionally one or more additives (e.g., hydrophobic agents, plasticizers, crosslinking agents, or stabilizers). Generally, the amounts of cellulose nanofiber and additives are selected to provide molded pulp products with desired material properties. The composite molded pulp products disclosed herein may comprise additional minor components, including, but not limited to, crosslinking agents. In some embodiments, the crosslinking agent also functions as a stabilizer.

In certain embodiments, the present invention relates to methods of making composite pulp products from fibrous fruit or vegetable pomace and fibrous paper-based material. The composite molded pulp products disclosed herein and the methods of making them are useful in providing alternative molded pulp products that do not rely on fibrous paper-based material, such a recycled newspaper, cardboard, or wood pulp, as the main or sole source of fiber for the product.

In some embodiments, the present disclosure relates to composite molded pulp products comprising a pulp component, wherein the pulp component comprises from about 50% to about 100% fibrous fruit or vegetable pomace by weight and from about 0% to about 50% fibrous paper-based material by weight. For each such product, the combined amounts of fibrous fruit or vegetable pomace and fibrous-paper based material, i.e., the pulp component, total about 100% by weight of the constituents of the molded product. In regards to a composite molded pulp product, the phrase "about 100%" is intended take into account the possible presence of minor cellulose nanofiber and optional additive components. It is therefore accurate to say that "about 100%" means 100% minus the amount of any minor component or components. By way of example, if a molded pulp product of the present invention comprises 0.5% minor components by weight, then the total amounts of fibrous fruit or vegetable pomace and fibrous-paper based material described as "about 100%," would mean and be understood by those skilled in the art to mean 99.5%.

In some embodiments, composite molded pulp products of the present disclosure comprise a fibrous fruit or vegetable pomace suitable for constructing composite molded pulp products. Generally, any fibrous fruit or vegetable pomace is suitable and can be used to construct the products of the present disclosure. In embodiments, the fibrous fruit, vegetable, or grain pomace is pomace derived from blueberry, cranberry, mango, apple, pumpkin, squash, carrot, beet, kale, celery, rhubarb, brewing spent grain, rice hulls, or a combination thereof.

In certain embodiments of the composite molded pulp products of the present disclosure, the fruit pomace or combination thereof is selected to achieve a lignocellulosic composition or fiber morphology that is compatible with the fibrous paper based material, such that the resulting composite molded product has desired water absorption, flexural strength, or flexural strain properties.

Referring now to Table 1, the lignocellulosic compounds for different wet fruit pomace are reported on dry basis. It is believed that the lignocellulosic composition of different fibrous fruit or vegetable pomaces influences the performance and material properties of composite molded pulp products that incorporate them. Therefore, it may be desirable to select a single fibrous fruit or vegetable pomace, or combination of pomaces, based on the lignocellulosic composition of the pomace or pomaces.

TABLE 1

Lignocellulosic compounds for different wet fruit pomace reported on dry basis

| | | Cellulose (%)[++] | | | Acid-insoluble | |
|---|---|---|---|---|---|---|
| | Pectin (%)[+] | α-cellulose | β-cellulose | γ-cellulose | lignin (%) | Ash (%) |
| Blueberry | $1.69^{c}$ | $76.19^{a}$ | $8.44^{a}$ | $15.37^{c}$ | $36.81^{b}$ | $1.08^{b}$ |
| Cranberry | $10.58^{b}$ | $73.77^{b}$ | $2.27^{c}$ | $23.96^{b}$ | $43.51^{a}$ | $0.75^{c}$ |
| Apple | $18.87^{a}$ | $65.83^{c}$ | $5.95^{b}$ | $28.23^{a}$ | $8.72^{c}$ | $1.93^{a}$ |

[+]Pectin was obtained by the treatment of pH 2.5 at 95° C. for 30 min.

[++]Celluloses were obtained after bleaching the fruit pomace with 2.8% $H_2O_2$ at pH 12 and 80° C. for 1 h.

Means with different lowercase superscripts in the same column indicated significant difference ($P < 0.05$) among fruit pomace.

In certain embodiments, the fibrous paper-based material of the composite molded pulp products of the present disclosure is newspaper, recycled newspaper, paperboard, recycled paperboard, newsprint, or a combination thereof.

In some embodiments, composite molded pulp products of the present disclosure comprise a ratio of fibrous fruit or vegetable pomace to fibrous paper-based material and the amount of cellulose nanofiber and additives that are sufficient to provide a molded pulp packaging product with desired inter-fiber bonding, water resistance, flexural strength, flexural strain, or protective cushioning properties. As elucidated by the examples below, a desired ratio of fibrous fruit pomace to fibrous paper-based material may be selected, at least in part, based on the fibrous fruit or vegetable pomace, or combinations of pomaces, which is used to construct the molded pulp product. In some embodiments, the ratio of fibrous fruit or vegetable pomace to fibrous paper-based material can be 1:1, 2:1, 3:1, 4:1, 5:1, 6:1, 7:1, 8:1, 9:1, 10:1, or 20:1. In some embodiments, the fibrous paper based material may be a minor component of the molded pulp product. In other embodiments, the only substantial source of fiber in a composite molded pulp product of the present disclosure is a fibrous fruit or vegetable pomace, or a combination of one or more fibrous fruit or vegetable pomaces, such that a molded pulp product comprises the fruit or vegetable pomaces and any minor components, and is substantially free of any fiber derived from a fibrous paper-based material. In some embodiments, the fibrous fruit or vegetable pomace is blueberry, cranberry, apple, or a combination thereof.

Generally, it is expected that the molded pulp products of the present disclosure will comprise no more than 5% (wet base) by weight of a minor component or combinations of minor components. In some embodiments, the molded pulp products comprise less than 5.0%, 4.9%, 4.8%, 4.7%, 4.6%, 4.5%, 4.4%, 4.3%, 4.2%, 4.1%, 4.0%, 3.9%, 3.8%, 3.7%, 3.6%, 3.5%, 3.4%, 3.3%, 3.2%, 3.1%, 3.0%, 2.9%, 2.8%, 2.7%, 2.6%, 2.5%, 2.4%, 2.3%, 2.2%, 2.1%, 2.0%, 1.9%, 1.8%, 1.7%, 1.6%, 1.5%, 1.4%, 1.3%, 1.2%, 1.1%, 1.0%, 0.9%, 0.8%, 0.7%, 0.6%, 0.5%, 0.4%, 0.3%, 0.2%, 0.1%, or 0.05% by weight of a minor component or combination of minor components. As discussed above, with respect to the amount of fibrous material in molded pulp products of the present disclosure, the phrase "about 100%" is intended to encompass 100% minus any amount of minor component or components. Accordingly, in certain embodiments, the present disclosure relates to composite molded pulp products comprising at least 95.0%, 95.1%, 95.2%, 95.3%, 95.4%, 95.5%, 95.6%, 95.7%, 95.8%, 95.9%, 96.0%, 96.1%, 96.2%, 96.3%, 96.4%, 96.5%, 96.6%, 96.7%, 96.8%, 96.9%, 97.0%, 97.1%. 97.2%, 97.3%, 97.4%, 97.5%, 97.6%. 97.8%, 97.9%, 98.0%, 98.1%, 98.2%, 98.3%, 98.4%, 98.5%, 98.6%, 98.7%, 98.9%, 99.0%, 99.1%, 99.2%, 99.3%, 99.4%, 99.5%, 99.6%, 99.7%, 99.8%, 99.9%, or 99.95% by dry weight total fibrous material including fibrous fruit or vegetable pomace and fibrous paper-based material.

Examples of hydrophobic agents include, but are not limited to alkylketen dimer (AKD), alkenylsuccinic anhydride (ASA), rosin products, and other internal sizing chemicals.

Examples of plasticizers include, but are not limited to, glycerin, propylene glycol, sorbitol solutions, sorbitan monostearate, sorbitan monoleate, lactamide, acetamide DEA, lactic acid, polysorbate 20, polysorbate 60, polysorbate 80, polyoxyethylene-fatty esters and ethers, sorbitan-fatty acid esters, polyglyceryl-fatty acid esters, triacetin, dibutyl sebacate, or combinations thereof. The extensive hydrogen bonds among cellulose chains are reduced by adding plasticizer, which in turn improves inter-fiber bonding and mechanical properties of produced molded pulp packages.

In some embodiments, composite molded pulp products of the present disclosure comprise a crosslinking agent. Examples of crosslinking agents include, but are not limited to, carboxylic acids; carboxy- or sulfate-containing polysaccharide selected from alginic acid, sodium alginate, carboxymethyl cellulose, pectic polysaccharides, carboxymethyl dextran, xanthan gum, carboxymethyl starch, hyaluronic acid, dextran sulfate, pentosan polysulfate, carrageenans, fuciodans, starch; cationic compounds selected from chitosan, metals, and proteins; and non-ionic compounds selected from cellulose derivatives, epichlorohydrin, glutaraldehyde, or a combination thereof. Crosslinking agents may be used as a stabilizer by improving inter-fiber bonding of pulp slurry and mechanical properties of molded pulp packages. These crosslinking agents are adsorbed to the surface of cellulosic fibers, which improves the molecular adhesion between fibers.

In certain embodiments, composite molded pulp products of the present disclosure have improved water absorption, flexural strength, or flexural strain properties, as compared to a similar molded product made from 100% fibrous paper based material.

Methods of Making Composite Molded Pulp Products

Generally, composite molded pulp products of the present disclosure can be made by methods similar to those used to make traditional molded pulp products.

In some embodiments, composite molded pulp products of the present disclosure can be made according the following steps.

In some embodiments, preparing a pulp slurry by grinding or blending together a fibrous fruit pomace and a fibrous paper-based material, in the presence of water, to provide a mixed pulp slurry; adding into the mixed pulp slurry an amount of cellulose nanofiber and additives, to provide a composite slurry with approximately from 2.5-10.0% solids; molding for a time the pre-molded composite slurry into a desired shape to provide a wet composite molded pulp product, wherein the vacuum molding includes a pulp forming time and a dwelling time; pulp forming time (seconds) is the vacuum duration time for collecting fibers from slurry; dwelling time (seconds) is also vacuum duration time for removing water from the molded pulp fibers; drying the wet composite molded product at a drying temperature sufficient to provide a composite molded pulp product.

In certain embodiments, the wet composite molded product formed from the pulp forming and dwelling is from 20% to about 50% solids.

In some embodiments, the solids in the composite slurry are from about 50% to about 100% pomace-derived products. In other embodiments, the solids are about 100%, about 95%, about 90%, about 85%, about 80%, about 75%, or about 70% pomace-derived solids.

In some embodiments, a pulp slurry used in making composite molded pulp products of the present disclosure comprises from about 0.005% to about 1%, from about 0.005% to about 0.550%, from about 0.04% to about 0.3%, from about 0.01% to about 0.5% by weight (wet base) cellulose nanofiber.

In some embodiments, the composite molded pulp products disclosed herein comprise cellulose nanofiber in the amount that totals from about 0.0125% to about 10%, from about 0.0125% to about 2%, from about 0.0125% to about 1%, from about 0.0125% to about 0.5%, from about 1% to about 5%, or from about 5% to about 10% of the molded product by weight.

In some embodiments, a pulp slurry used in making composite molded pulp products of the present disclosure comprises from about 0.005% to about 0.25% by weight (wet base) hydrophobic agents.

In certain embodiments, a pulp slurry used in making composite molded pulp products of the present disclosure comprises from about 0.01% to about 0.66% by weight (wet base) a plasticizer. The plasticizer used may depend, at least in part, on the type of pomace used in making a particular composite molded pulp product.

In other embodiments, a pulp slurry used in making composite molded pulp products of the present disclosure comprises from about 0.01% to about 0.66% by weight (wet base) of a stabilizing agent. The stabilizer may be chosen, in part, based on the type of pomace used in making a particular composite molded pulp product.

In some embodiments, a pulp slurry used in making composite molded pulp products of the present disclosure comprises from about 0.01% to about 2.00% by weight (wet base) of a crosslinking agent. The crosslinking agent may be chosen, in part, based on the type of pomace used in making a particular composite molded pulp product.

In particular embodiments, the pulp slurry is prepared to provide a slurry with desirable water retention or consistency. Without limiting the invention, examples of pulp slurries with desirable water retention and consistency are shown in table 2.

TABLE 2

Properties of pulp slurry for each run in response surface methodology

| | | | Blueberry pomace | | Cranberry pomace | | Apple pomace | |
|---|---|---|---|---|---|---|---|---|
| Run | FP:NP | CNF (%) | Water retention value (%)[+] | Consistency (cm)[++] | Water retention value (%) | Consistency (cm) | Water retention value (%) | Consistency (cm) |
| 1 | 1.29:1 | 0.04 | 238.16 ± 4.55 | 7.25 ± 0.50 | 272.46 ± 10.68 | 6.67 ± 0.14 | 337.78 ± 7.88 | 5.58 ± 0.29 |
| 2 | 2.71:1 | 0.04 | 245.26 ± 6.24 | 7.00 ± 0.25 | 286.44 ± 7.79 | 7.33 ± 0.14 | 391.53 ± 17.08 | 5.33 ± 0.63 |
| 3 | 1.29:1 | 0.26 | 259.73 ± 7.03 | 6.00 ± 0.25 | 283.33 ± 11.96 | 5.08 ± 0.14 | 312.74 ± 5.45 | 4.83 ± 0.14 |
| 4 | 2.71:1 | 0.26 | 267.12 ± 4.56 | 6.33 ± 0.14 | 310.60 ± 6.71 | 5.42 ± 0.14 | 412.54 ± 8.08 | 5.00 ± 0.00 |
| 5 | 1:1 | 0.15 | 246.39 ± 1.95 | 6.25 ± 0.00 | 276.13 ± 4.93 | 5.33 ± 0.29 | 327.52 ± 20.98 | 5.17 ± 0.14 |
| 6 | 3:1 | 0.15 | 256.96 ± 5.07 | 7.08 ± 0.52 | 301.36 ± 11.89 | 5.92 ± 0.14 | 410.38 ± 31.40 | 4.83 ± 0.14 |
| 7 | 2:1 | 0 | 229.65 ± 5.49 | 7.17 ± 0.29 | 286.91 ± 5.34 | 6.00 ± 0.25 | 368.20 ± 19.07 | 5.17 ± 0.29 |
| 8 | 2:1 | 0.3 | 252.96 ± 4.44 | 6.50 ± 0.66 | 299.53 ± 5.55 | 5.17 ± 0.14 | 372.57 ± 4.35 | 5.00 ± 0.25 |
| 9 | 2:1 | 0.15 | 243.11 ± 7.05 | 6.42 ± 0.38 | 293.92 ± 4.98 | 6.00 ± 0.00 | 376.71 ± 9.65 | 5.08 ± 0.14 |
| 10 | 2:1 | 0.15 | 246.64 ± 2.76 | 6.67 ± 0.14 | 293.97 ± 2.22 | 6.17 ± 0.14 | 382.83 ± 5.67 | 5.25 ± 0.25 |
| 11 | 2:1 | 0.15 | 250.95 ± 1.89 | 6.50 ± 0.25 | 294.84 ± 3.89 | 6.00 ± 0.00 | 381.26 ± 13.36 | 5.00 ± 0.25 |
| 12 | 2:1 | 0.15 | 251.50 ± 4.76 | 6.17 ± 0.14 | 295.53 ± 1.10 | 6.08 ± 0.14 | 392.73 ± 6.96 | 4.92 ± 0.14 |

[+]Water retention values were obtained as: the weight of 0.3% slurry after centrifugation at 3000 g and 2° C. for 30 min was divided by the weight of dried slurry at 105° C. for 24 h and multiplied by 100.

[++]Consistency were analyzed on 0.9% pulp slurry released for 30 s.

In some embodiments, the fibrous fruit or vegetable pomace is a pretreated prior to grinding or blending it together with the fibrous paper-based material, to achieve stronger fiber bonding and less water holding capacity of slurry. In certain embodiments, "pretreated pomace" means pomace that has been treated by chemical methods, biological methods, or their combination to improve the external fibrillation for better interactions with other compounds. In some embodiments, fruit or vegetable pomace is pretreated by subjecting it to chemical, physical, and/or enzymatic treatments to help liberate fibers from pomace, to make fiber softer, an/or to reduce fiber diameter.

In certain embodiments, the pulp forming time is from about 2 seconds to about 20 seconds; the duration time alters the amount of collected fibers from the slurry and thickness of molded pulp containers.

In some embodiments, the dwelling time is from about 4 seconds to about 20 seconds; the duration time alters the amount of water remained in the wet molded pulp containers, thus influencing the drying process.

In some embodiments, the drying temperature is from about 100° C. to about 125° C., from about 125° C. to about 150° C., from about 150° C. to about 175° C., from about 175° C. to about 200° C., or a combination thereof; optimum temperature or a combination thereof induces the constant drying rate throughout fiber web in the wet molded pulp packages, thus preventing the warping of dried one (moisture content ~10%). In embodiments, the drying time is 5-15, 15-25, 25-35, or 35-45 minutes, or a combination thereof; the series of drying time under different temperature occurs the constant drying rate throughout fiber web and induces the economical, fast drying to reach approximately 10% moisture content of dried molded pulp containers.

In certain embodiments, multiple stages of drying may be employed using different combinations of temperature and time to generate high quality products. The employing of multiple drying times may assist with overcoming challenges related to fiber water holding, which can vary depending on the types of pomace. For example, an initially higher temperature for a short time may be followed by reducing the temperature to a lower temperature for a given time.

Traditional molded pulp products may be made by a variety of methods, all of which may be useful in making composite molded pulp products of the present disclosure.

EXAMPLES

Example 1

Various Composite Molded Pulp Products

Generally, molded pulp is a packaging material traditionally made from recycled paperboard or newsprint. In embodiments, the present disclosure provides for a composite molded pulp that reduces the reliance on traditional fibrous paper-based materials, by provided a composite molded pulp and molded pulp products that incorporate fibrous fruit or vegetable pomace as an alternative fiber source. The composite molded pulp of the present disclosure is useful in making a variety of composite molded pulp products. Composite molded products of the present disclosure may be thick wall, transfer molded, thermoformed fiber, or processed molded pulp products. Examples of more specific products include, but are not limited to, protective packaging materials, food service trays, and beverage carriers, nursery pot, egg carton, end caps, trays, plates, bowls, and clamshell containers.

Example 2

Materials and Methods

The following materials and methods are provided to assist those skilled in the art with making and using the various embodiments of the present invention. They are not intended to limit the scope of the invention in any way. The skilled artisan will appreciate that modifications and adaptations to these materials and methods may be made without departing from the scope of the present invention as set forth in the present disclosure.

Materials

Fresh blueberry (BP) and cranberry pomace (CP) were donated by Kerr Concentrates, Inc. (Salem, Oreg.) and fresh apple pomace (AP) was donated by Hood River Juice Co. (Hood River, Oreg.). Fresh pomace were packed in plastic pails and stored in a freezer at −18° C. until usage. NP slurry was provided by Western Pulp Products Co. (Corvallis, Oreg.) and CNF slurry (~3.0% solid) was obtained from the Process Development Center of the University of Maine (Orono, Me.). Glycerol and potassium dichromate were purchased from Alfa Aesar (Ward Hill, Mass.), citric acid monohydrate from Macron Fine Chemicals (Center Valley, Pa.), ferrous sulfate heptahydrate from Mallinckrodt Chemicals (Phillipsburg, N.J.), and ferroin indicator from Ricca Chemical Company (Arlington, Tex.). All other solvents and reagents were analytical grade and used without further purification.

Cellulosic Composition Analysis of FP

Plant cell walls consist of 1) structural material, termed lignocellulosic compounds (i.e. cellulose, hemicellulose, and lignin) that are strongly entangled and chemically bonded through covalent and non-covalent bonds, and 2) nonstructural material, termed extractives (i.e. organic compounds, such as pectin, proteins, tannins, waxes, aromatics, and low molecular weight carbohydrates) and extraneous materials (i.e. inorganic compounds such as calcium and silica) (Pérez, Muñoz-Dorado, de la Rubia, & Martínez, 2002; Stokke, Wu, Han, & Stevens, 2013). Cell wall materials can vary depending on the source of FP, which impact structure-dependent functional and material properties (Kunzek, Kabbert, & Gloyna, 1999). For understanding the impact of different FP on the characteristics of FPBs, cellulosic compositions and fiber morphologies of BP, CP, and AP were analyzed.

Pectin

Pectin was extracted following the method of Canteri-Schemin et al. (2005) with some modifications. Briefly, 5 g of FP was mixed with 250 mL of citric acid solution (pH 2.5), and incubated in a water bath (Precision, Model Shallow Form Bath, LabCare America, Winchester, Va.) at 95° C. for 30 min. The mixture was filtered through a Whatman #1 filter paper (Whatman™, Buckinghamshire, UK), and the filtrate was stored at 4° C. overnight. The filtrate was mixed with 125 mL of 96% ethanol, stirred for 10 min, and left at room temperature overnight to precipitate the pectin. The precipitated pectin was filtered through the filter paper, dried in an oven (Isotemp® Oven Forced Draft, Fisher Scientific, Waltham, Mass.) at 55° C. for 24 h, and determined gravimetrically.

Cellulose

FP was bleached with 2.8% hydrogen peroxide at pH 12 and 80° C. for 1 h (Renard et al., 1997). The α-, β-, and γ-celluloses were analyzed following testing method TAPPI T 203 cm-99. Briefly, about 1.5 g of bleached sample was mixed with 100 mL of 17.5% sodium hydroxide and stirred with a spin bar until fully dispersed. After 30 min, 100 mL of distilled water (DW) was added, incubated for 30 min under stirring, and filtered through a filter paper (VWR®, Qualitative 417, China) to obtain the filtrate, which was used to analyze the α-cellulose. For obtaining γ-cellulose, 50 mL of pulp filtrate was mixed with 50 mL of 3N sulfuric acid and heated in the water bath at 80° C. for 10 min. The mixture was allowed to precipitate overnight, centrifuged (Sorvall® Instruments, Model RC-5C, Newtown, Conn.) at 8,000 rpm for 30 min, and filtered through the filter paper to obtain a clear solution, which was used to analyze γ-cellulose. The α- and γ-celluloses were determined by titration using 0.1N ferrous sulfate solution and ferroin indicator to a yellow black color. The β-cellulose was obtained by subtracting 100% with α- and γ-cellulose values.

Acid-Insoluble Lignin

Acid-insoluble lignin was analyzed following TAPPI T 222 om-02. Briefly, 2 g of unbleached sample was mixed with 40 mL of 72% sulfuric acid and kept in the water bath at 23° C. for 2 h. The suspension was diluted to 3% sulfuric acid by adding 1,540 mL of DW, and then boiled in the water bath for 4 h. The insoluble material was allowed to settle overnight and then filtered through a crucible. The acid-insoluble lignin was gravimetrically determined by drying the crucible in the oven at 105° C. for 24 h.

Ash

Ash in FP was analyzed following TAPPI T 211 om-02 by igniting the sample in a furnace (Thermolyne, Model F-A1730, Sybron Corp., Dubuque, Iowa) at 525° C. for 5 h.

Morphology of FP Fibers

Insoluble fiber (ISF) of FP was prepared according to the method of Deng et al. (2011) and characterized using a stereomicroscope (Leica Microsystems (Schweiz) AG, Heerbrugg, Switzerland) equipped with an extended digital camera (Q Imaging, Surrey, British Columbia, Canada). The morphology of ISF was investigated using a scanning electron microscope (SEM) (FEI Quanta 600F, OR, USA) by placing sample on aluminum stub and coated by gold palladium alloy sputter coater (Cressington Scientific Instruments Ltd., UK). Digital images were collected at an accelerating voltage of 5 kV.

Development of FPBs

FPBs were created to possess similar water resistance and mechanical properties to 100% NPB. The FP-to-NP (FP/NP) ratio and CNF concentration were selected as two treatment factors since they showed significant impact on water absorption, flexural strength, and flexural strain of FPBs based on our preliminary studies. In addition, 0.15% glycerol (w/w, wet basis) as a plasticizer was added to all samples for improving the water resistance and mechanical properties.

Central Composite Design (CCD)

FP/NP ratio (1:1 to 3:1 based on insoluble solid content (ISC) of slurry) and CNF concentration (0 to 0.3%, wet basis) were optimized through CCD. Design-Expert® V10 statistical software (Stat-Ease, Inc., MN, USA) was used for regression and graphical data analyses. The optimum result of each FPB was obtained based upon the highest desirability function (0-1) provided by the software, in which "0" indicates one or more responses deviating from the prediction values and "1" indicates meeting all goals perfectly.

Pulp Slurry (PS) Preparation

Frozen BP, CP, and AP were thawed at room temperature overnight. About 200 g of FP was blended with 1 L of tap water for 20 min in a food processor (Black & Decker®, Towson, Md.). The slurry was filtered through the filter paper under vacuum, dried at 105° C. for 24 h, and then gravimetrically measured for ISC, which was 8.41%, 4.97%, 3.65%, and 4.34% for BP, CP, AP, and NP, respectively.

One liter of PS was prepared by combining FP, NP, glycerol, and CNF according to the guideline from CCD. FP and NP at given ratio was mixed (KitchenAid® Professional 600, St. Joseph, Mich.) for 15 min, followed with the addition of 0.15% glycerol. CNF and tap water were then added to make a final mixture with 3% solid.

Water Retention Value (WRV) and Consistency of PS

WRV was determined following ISO 23714:2007 with some modifications. Briefly, 3% PS was diluted to obtain 0.3% suspension. A 100 g of 0.3% suspension was filtered through Whatman GF/A filter paper (Buckinghamshire, UK) under vacuum. The test-pad was removed, placed in a falcon tube, and centrifuged (Sorvall® Instruments, Model RC-5C, Newtown, Conn.) at 3,000 g and 2° C. for 30 min. The test-pad was weighed, dried in the oven at 105° C. for 24 h, and WRV was determined gravimetrically.

The consistency of PS was determined by Bostwick consistometer (CSC Scientific Co., VA). Briefly, 3% PS was diluted to obtain 0.9% suspension. Then, 25 g of 0.9% suspension was placed in the consistometer and released for 30 s. The distance of the flowed suspension was measured and reported as consistency.

Preparation of FPBs

About 200 g of PS was molded in a 10×10 $cm^2$ self-assembled high-density polyethylene (HDPE) mold that was perforated to allow water release from the slurry. Two #70 mesh screens were placed on the top and bottom of the PS inside HDPE mold, respectively. PS in the mold was pressed by applying same pressure for all samples to remove flow water, followed by removing wet FPB from the mold and then drying in an impingement oven (Lincoln® Impinger®, Fort Wayne, Ind.) at 150° C. for 15 min. The dried FPB was stored in a desiccator before further analysis. Each board was considered as one replication, and three replications were applied for each formulation.

Water Absorption (Wa) of FPBs

Wa was analyzed following ASTM D570-98 with some modifications. Sample specimen (3×4 cm) was weighed and submerged in DI water at 23° C. for 24 h, vertically suspended from one corner for 30 s to allow the water to drain off, and reweighed. Wa was calculated as the percentage of weight increase in submerged sample to the initial weight of dry specimen.

Mechanical Property of FPBs

Mechanical property of FPBs was measured using a three-point bending test following ASTM D790-15e2 standard on the TA-XT2 Texture Analyzer (Texture Technologies Corp., Scarsdale, N.Y.). The samples (1.27×0.2×10 cm) were conditioned following ASTM D618-13 at 23° C. and 50% RH using a saturated magnesium nitrate (Billerica, Mass.). The support span and crosshead speed were set at 37.5 mm and 1.4 mm/min, respectively. Flexural strength, modulus of elasticity, and flexural strain were calculated from the obtained curve.

Verification Study

The optimized levels of FP/NP ratio and CNF concentration obtained from the CCD and Design-Expert® V10 for each FP were used to make a new set of FPBs, and their Wa, flexural strength, and flexural strain were compared with the prediction values. In addition, these FPBs were analyzed for thermal, structural, and morphological properties.

Thermal Property by Differential Scanning Calorimetry (DSC)

DSC measurement of FPB powders was performed using DSC Q2000 (TA Instruments, New Castle, Del.). About 6 mg of sample was tested from 0 to 250° C. with a heating rate of 20° C./min under a nitrogen atmosphere. Endothermic peak was evaluated for each FPB.

Structural Property by Fourier Transform Infrared (FTIR) Spectroscopy

FPB powders were mixed with potassium bromide powders (FTIR Spectrograde, International Crystal Labs, Garfield, N.J.) at a ratio of 1:100. The mixture was compressed into a thin film flake, and analyzed by FTIR spectrometer (Nicolet iS50 FT-IR, Thermo Scientific, Madison, Wis.) for the functional groups in each FPB. The absorbance from 4000 to 400 cm-1 with the average of 32 individual scans was collected at a resolution of 4 cm-1.

Morphological Property Evaluated by SEM

The microstructure (surface and cross-section) of FPBs was investigated by SEM. Prepared sample was placed on aluminum stub and coated by gold palladium alloy sputter coater. Digital images were collected at an accelerating voltage of 5 kV.

Statistical Analysis

All experiments were conducted in triplicate and mean value and standard deviation were reported. The data for chemical compositions of FP were analyzed via one-way analysis of variance (ANOVA) with a least significant difference (LSD) post hoc multiple comparison test ($P<0.05$), while the optimization study was evaluated using the statistical analysis provided by Design-Expert® V10.

Example 3

Additional Discussion and Guidance for Various Embodiments and Examples

Cellulosic composition and morphological properties of FP

Table 1 reports pectin, lignocellulosic compounds, and ash contents of blueberry pomace (BP), cranberry pomace (CP), and apple pomace (AP). It is possible that pectin contents of AP (18.9%) and CP (10.6%) were higher than BP (1.7%) because AP and CP are rich in protopectin.

In order to achieve high strength in composite molded pulp products of the present disclosure, the applicants sought to utilize material with more than 34% of α-cellulose (higher molecular weight in comparison to β- and γ-cellulose). Accordingly, applicants utilized a FP having more than 34% of α-cellulose. For example, where BP had the highest (76%), followed by CP (74%) and AP (66%). The β- and γ-celluloses from BP, CP, and AP were 8%, 2%, and 6%, and 15%, 24%, and 28%, respectively. Acid-insoluble lignin in CP (44%) and BP (37%) were significantly higher ($P<0.05$) than AP (9%) because CP and BP have many seeds. All FP had ash content <2%, providing good sources of materials for producing pulp composites.

The images of wet FP, their insoluble fibers, and fiber microstructures are shown in FIG. 1. BP and CP mainly consist of skins and seeds, while AP is dominant by pulp and some skins, seeds, and stems. BP has smaller seeds and softer skins than CP, whereas AP has larger and thicker skins than CP. SEM images illustrated that: 1) BP fibers had the smallest diameter among all FP and were well-packed via entanglement among the fibrils, 2) CP fibers possessed relatively larger diameter and had less entanglement among the fibrils compared to BP fibers, and showed strong inter-fiber bonds, and 3) AP fibers had the largest diameter, the least entanglement, and the strongest inter-fiber bonds among FP. This information is important since it directly affects the characteristics of PS and FPBs.

PS Properties

WRV and consistency value were used to evaluate the drain ability as a result of external fibrillation of FP (Table 2).

WRVs of AP-PS were the highest (313-413%), followed by CP-PS (272-311%) and BP-PS (230-267%), showing that WRVs were affected by the types of FP. WRV is a complex phenomenon, which is not only affected by the chemical composition of the pulp, but also by the morphology of the fiber. AP contains the highest hemicellulose and has porous matrix structure formed by polysaccharide chains, thus possessing high water retention ability through hydrogen bonds. It was also observed that WRVs of PS were increased along with the increment concentration of FP or CNF. CNF had high aspect ratio and surface areas with hydroxyl groups, resulting in higher water retention ability.

The consistency values of PS supported the WRV results (Table 2). Overall, BP-PS had the lowest consistency (6.0-7.3 cm), followed by CPPS (5.0-7.3 cm) and APPS (4.8-5.6 cm). In general, higher concentration of BP or CP at the same level of CNF made the PS less viscous, while vice versa in AP-PS. The porous structure of AP fibers with higher pectin and hemicellulose contents than BP and CP caused fiber swelling, thus increasing the viscosity of PS. The addition of CNF also increased the consistency of PS as it has high water holding ability.

The characteristics of PS depend on the types of FP and the addition of CNF, which further impact water resistance and mechanical properties of FPBs. Accordingly, one skilled in the art would recognize that based on the present disclosure, the types of FP and amount of CNF may be selected, to provide desired water resistance and mechanical properties to composite molded pulp products disclosed herein.

Properties of FPBs

Wa and mechanical properties of FPBs are reported in Table 3. Wa values of BP boards (BPBs) (155-216%) and CP boards (CPBs) (201-249%) had similar trends, where the incorporation of more pomace gave lower Wa values of FPBs, whereas Wa of AP boards (APBs) (269-431%) was heightened as concentration of AP increased. Three-dimensional plots for the combined effects of two treatment factors on Wa of FPBs can be seen in FIG. 2. Based on ANOVA analysis from Design-Expert® V10 (data not shown), the increment of BP/NP and CP/NP ratios significantly reduced Wa values ($P<0.05$), while vice versa for AP/NP ratio. As it was previously discussed, the porous structures in AP possessed many interfacial spaces between the fibers, and the large AP fiber size had less adhesion interactions with other cellulosic compounds, thus APBs were moreable to absorb water. In BPBs, fibers with smaller diameter were well packed with each other through entanglements, thus inducing less Wa. Similar to BPBs, CPBs with high α-cellulose content could reduce Wa as it has high crystallinity (Lee, 1960). The incorporation of CNF significantly reduced Wa values ($P<0.05$) (Table 4) in BPBs and CPBs since high aspect ratio of CNF could interact with FP fibers through adhesion mechanisms, thus resulting in better bonding ability between FP and CNF.

TABLE 3

Water absorption and mechanical properties of fruit pomace boards as related to fruit pomace (FP)-to-newspaper (NP) ratio and cellulose nanofiber (CNF) concentration (on a dry basis) for each run in response surface methodology

| | | | Blueberry pomace (BP)[+] | | | | Cranberry pomace (CP) | | | | Apple pomace (AP) | | | |
|---|---|---|---|---|---|---|---|---|---|---|---|---|---|---|
| Run | FP:NP | CNF (%) | Wa (%) | GfM (MPa) | Ef (MPa) | ϵf (%) | Wa (%) | GfM (MPa) | Ef (MPa) | ϵf (%) | Wa (%) | GfM (MPa) | Ef (MPa) | ϵf (%) |
| 1 | 1.29:1 | 0.04 | 216.49 | 3.08 | 101.30 | 5.01 | 249.10 | 3.91 | 126.52 | 5.35 | 328.28 | 3.19 | 75.65 | 7.05 |
| 2 | 2.71:1 | 0.04 | 178.81 | 2.93 | 92.75 | 4.32 | 225.21 | 4.55 | 154.22 | 4.66 | 416.90 | 3.95 | 115.87 | 6.31 |
| 3 | 1.29:1 | 0.26 | 181.19 | 4.15 | 116.00 | 6.11 | 215.91 | 4.79 | 132.86 | 7.24 | 269.27 | 4.92 | 140.17 | 6.84 |
| 4 | 2.71:1 | 0.26 | 154.81 | 3.89 | 117.04 | 5.81 | 201.47 | 4.40 | 123.33 | 6.29 | 402.45 | 5.42 | 114.12 | 9.41 |
| 5 | 1:1 | 0.15 | 206.24 | 3.83 | 134.56 | 4.73 | 241.44 | 4.08 | 130.88 | 5.80 | 291.16 | 4.34 | 135.52 | 5.59 |
| 6 | 3:1 | 0.15 | 155.19 | 3.13 | 101.96 | 4.55 | 213.14 | 4.12 | 127.90 | 5.80 | 431.35 | 5.58 | 174.15 | 6.70 |
| 7 | 2:1 | 0 | 208.72 | 2.57 | 90.98 | 3.98 | 245.38 | 3.65 | 136.59 | 4.40 | 336.71 | 3.65 | 106.70 | 5.56 |
| 8 | 2:1 | 0.3 | 160.34 | 4.02 | 103.48 | 6.68 | 208.76 | 5.29 | 145.13 | 6.32 | 320.54 | 5.70 | 130.55 | 8.86 |
| 9 | 2:1 | 0.15 | 174.92 | 3.37 | 113.76 | 4.43 | 225.96 | 4.23 | 136.57 | 5.65 | 326.47 | 5.37 | 133.46 | 7.21 |
| 10 | 2:1 | 0.15 | 173.11 | 3.60 | 123.87 | 4.82 | 224.33 | 3.99 | 111.98 | 5.79 | 335.04 | 5.01 | 116.15 | 7.25 |
| 11 | 2:1 | 0.15 | 181.68 | 3.43 | 104.39 | 5.02 | 222.31 | 4.42 | 144.64 | 5.42 | 340.41 | 5.61 | 153.39 | 7.29 |
| 12 | 2:1 | 0.15 | 170.68 | 3.42 | 107.95 | 4.86 | 229.47 | 4.25 | 129.76 | 5.30 | 350.89 | 4.64 | 114.87 | 7.10 |

[+]Wa = Water absorption;

$$\text{Flexural strength (GfM)} = \frac{3FL}{2bd^2};$$

$$\text{Modulus of elasticity (Ef)} = \frac{L^3m}{4bd^2};$$

$$\text{Flexural strain } (\epsilon f) = \frac{6Dd}{L^2} \times 100.$$

F = Load at a given point on the load deflection curve (N);
L = Support span (mm);
b = Width of tested beam (mm);
d = Thickness of tested beam (mm);
D = Maximum deflection of the center of the beam (mm);
m = Slope of the initial straight-line portion of the load deflection curve (N/mm).

In general, the flexural strength of APBs (3.2-5.7 MPa) was greater than CPBs (3.7-5.3 MPa) and BPBs (2.6-4.2 MPa). The fracture of FPBs might be related to the dimension of fiber and the uniformity of drag force over fiber stiffness, and it began with the breakage of the inter-fiber bonds followed with several hundred microfibrils failure to propagate the cracks for a whole fiber. Three-dimensional plots for the combined effects of two treatment factors on the flexural strength of FPBs are reported in FIG. 2. The increment of BP/NP ratio significantly reduced the flexural strength ($P<0.05$) and vice versa for AP/NP ratio (Table 4). AP possessing the largest fiber size and stronger inter-fiber bonds among all FP required more energy to induce the fracture of fibers, thus resulting in high flexural strength. The addition of CNF to FPBs significantly ($P<0.05$) increased the flexural strength because it was well incorporated with other fibers for enhancing the strength of the bonds between fibers.

TABLE 4

ANOVA results for response surface model (type III) for blueberry pomace (BP), cranberry pomace (CP), and apple pomace (AP) combined newspaper (NP) molded pulp boards (MPBs)

| | | P-value | | |
|---|---|---|---|---|
| Parameter | Source | BPBs | CPBs | APBs |
| Water absorption | Model | <0.05 | <0.05 | <0.05 |
| | A-FP:NP | <0.05 | <0.05 | <0.05 |
| | B-CNF | <0.05 | <0.05 | 0.08 |
| | AB | 0.19 | — | — |
| | $A^2$ | 0.10 | — | — |
| | $B^2$ | <0.05 | — | — |
| | Lack of Fit | 0.84 | 0.50 | 0.14 |

TABLE 4-continued

ANOVA results for response surface model (type III) for blueberry pomace (BP), cranberry pomace (CP), and apple pomace (AP) combined newspaper (NP) molded pulp boards (MPBs)

| | | P-value | | |
|---|---|---|---|---|
| Parameter | Source | BPBs | CPBs | APBs |
| Flexural strength | Model | <0.05 | <0.05 | <0.05 |
| | A-BP:NP | <0.05 | 0.74 | 0.05 |
| | B-CNF | <0.05 | <0.05 | <0.05 |
| | AB | — | — | — |
| | $A^2$ | — | — | — |
| | $B^2$ | — | — | — |
| | Lack of Fit | 0.33 | 0.13 | 0.45 |
| Flexural strain | Model | <0.05 | <0.05 | <0.05 |
| | A-BP:NP | 0.31 | 0.13 | 0.07 |
| | B-CNF | <0.05 | <0.05 | <0.05 |
| | AB | — | — | <0.05 |
| | $A^2$ | — | — | — |
| | $B^2$ | — | — | — |
| | Lack of Fit | 0.16 | 0.19 | <0.05 |

In regard to modulus of elasticity (Table 3), it did not show a clear trend among FPBs. It is possible the elongation of pulp fiber occurs when the microfibrils slide to each other at the structural imperfections or uniformly along the fiber length. FPBs are pulp composite materials that have voids and highly porous, thus possibly resulting in high variation of elasticity modulus.

In respect to flexural strain of FPBs, a higher value indicates more flexible material. Overall, BPBs (4.0-6.7%) had slightly lower values than CPBs (4.4-7.2%), while APBs were the highest (5.6-9.4%). Three-dimensional plots for the combined effects of two treatment factors on the flexural strain of FPBs are illustrated in FIG. 2. Based on ANOVA analysis (Table 4), CNF concentration significantly increased this parameter (P<0.05) because CNF has long fibers with high aspect ratio, which might improve the flexibility of FPBs. Moreover, the interaction effect between AP/NP ratio and CNF concentration was also significant (P<0.05) because fibers from AP, NP, and CNF were well associated through mechanical interlocking. These results clearly showed that the types of FP and the incorporation of CNF significantly impacted water resistance and mechanical properties of FPBs.

Optimization of FPBs

The optimization of FPBs was aimed to have lower Wa and similar flexural strength and flexural strain compared to 100% NPB. As shown in Table 5, the optimum formula of each FPB according to Design-Expert® V10 is: 1) BP:NP=3:1 with 0.207% CNF for BPB, 2) CP:NP=3:1 with 0.005% CNF for CPB, and 3) AP:NP=1:1 with 0.094% CNF for APB. The desirability value of BPB was the highest (0.75) followed by CPB (0.65) and APB (0.39). The lower the desirability was detected, the higher the deviation of predicted values from the actual values occurred. The lower desirability of APB could be related to the difficulty in forming homogenous board due to the interference of thick skins, seeds, and stems presenting in AP.

were well associated with each other through complex adhesion mechanisms, including interdiffusion, mechanical interlocking, capillary forces, Coulomb forces, hydrogen bonding, and van der Waals forces. The utilizations of FP to partially substitute NP and the incorporation of CNF altered the thermal behavior of FPBs, in which the endothermic peaks were shifting from 103° C. for 100% NPB to 128° C., 137° C., 84° C., for optimized BPB, CPB, and APB, respectively. These results might relate to the lignin content in the FPBs (CP was the highest, followed by BP and AP) since lignin has high thermal resistance.

Figure 3A:
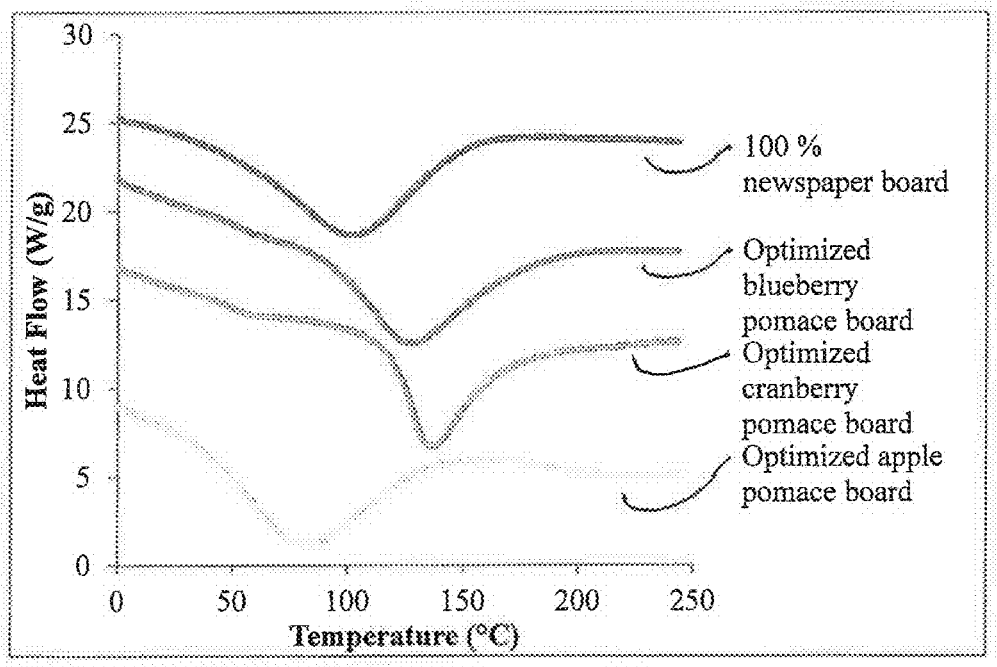
FIG. 3A is a comparison of heat flow as a function of temperature for representative fruit pomace boards (blueberry, cranberry, and apple) of the invention and 100% newspaper boards by differential scanning calorimetry (DSC).
Figure 3B:
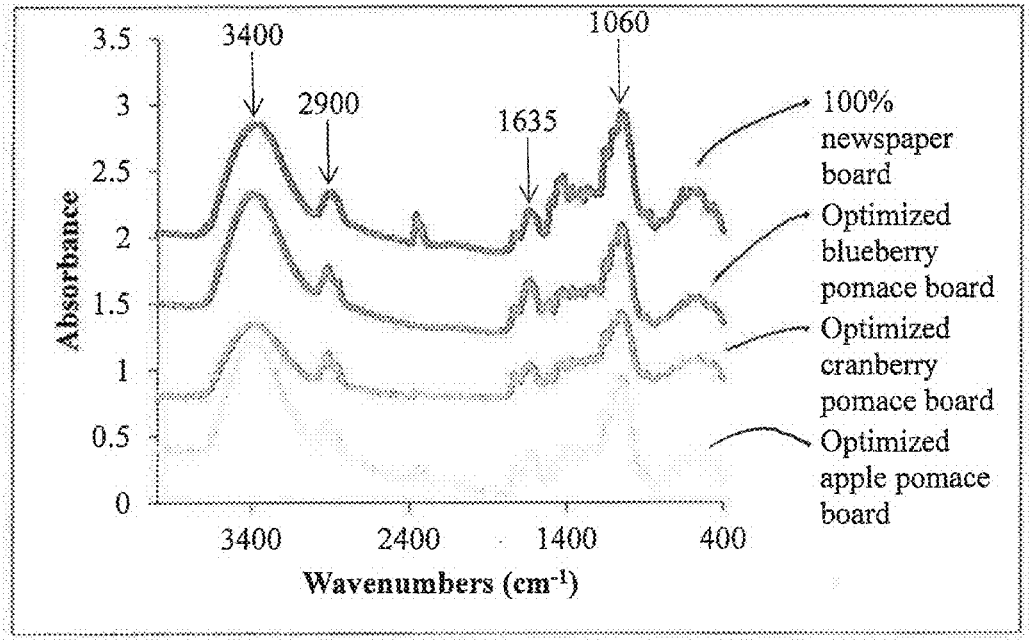
FIG. 3B is a comparison of absorbance (infrared) for the representative fruit pomace boards (blueberry, cranberry, and apple) and 100% newspaper boards by Fourier transform infrared (FTIR) spectroscopy.

FTIR spectra of 100% NPB and optimized FPBs are presented in FIG. 3*b*. All spectra showed broad bands at 3,400 cm-1, indicating the hydrophilic tendency of fibers as the presence of free O—H groups on celluloses. The fingerprints at 2,900 cm-1 represent the C-H asymmetric and symmetric stretching from aliphatic saturated compounds in hemicelluloses. The peaks at 1,635 cm-1 and 1,060 cm-1 are responsible to O—H bending of absorbed water and C—O stretching of cellulose, respectively. The similar FTIR structures of 100% NPB and optimized FPBs indicated the compatibility among FP, NP, and CNF, as their cellulosic compounds were well interacted through complex adhesion mechanisms.

TABLE 5

Comparison of measured water absorption and mechanical properties between predicted values from response surface methodology and actual values from reconstituted pulp board based upon the optimized formula

| Ratio | CNF (%) | | Water absorption (%) | | | Flexural strength (MPa) | | | Flexural strain (%) | | |
|---|---|---|---|---|---|---|---|---|---|---|---|
| NP only | 0 | | 341.14 | | | 3.48 | | | 4.31 | | |
| Optimized formula | | Desirability[+] | Predicted value | Actual value | Error (%)[++] | Predicted value | Actual value | Error (%) | Predicted value | Actual value | Error (%) |
| BP:NP = 3:1 | 0.207 | 0.75 | 151.65 | 156.15 | 2.88 | 3.48 | 3.63 | 4.01 | 5.24 | 5.22 | 0.37 |
| CP:NP = 3:1 | 0.005 | 0.65 | 229.98 | 220.97 | 4.08 | 3.84 | 3.42 | 12.24 | 4.31 | 5.22 | 17.41 |
| AP:NP = 1:1 | 0.094 | 0.39 | 277.92 | 278.30 | 0.14 | 3.84 | 4.26 | 9.85 | 6.62 | 4.64 | 42.54 |

NP = Newspaper; BP = Blueberry pomace; CP = Cranberry pomace; AP = Apple pomace

[+]Desirability function is obtained from Design Expert by considering all optimization goals (a value of 1 indicates where all optimization goals are met perfectly).

The optimization of fruit pomace and NP ratios and cellulose nanofiber (CNF) concentrations was aimed to obtain similar properties to 100% NP board.

[++]Error = (Actual value − Predicted value)/(Actual value) × 100

The Wa, flexural strength, and flexural strain of BPB were 156%, 3.6 MPa, and 5.2%, respectively (Table 5). The maximum error value was occurred in flexural strength (4.0%). On the other hand, Wa, flexural strength, and flexural strain of CPB were 221%, 3.4 MPa, and 5.2%, respectively, with much higher error values than BPB, especially in flexural strain (17.4%). Similar to CPB, APB had Wa, flexural strength, and flexural strain of 278%, 4.3 MPa, and 4.6%, respectively, again with the highest error value in flexural strain (42.5%). These results were in accordance to the desirability data (APB<CPB<BPB) from Design-Expert® V10 that were probably related to the components of each pomace: AP with thick skins and some seeds and stems, CP with larger seeds and skins compared to BP, and BP contains relatively smaller seeds and soft skin. Regardless of the errors between predicted and actual values, the optimized FPBs showed better or similar properties to 100% NPB.

Thermal and Structural Properties of FPBs

Figures 4A, 4B, 4C:
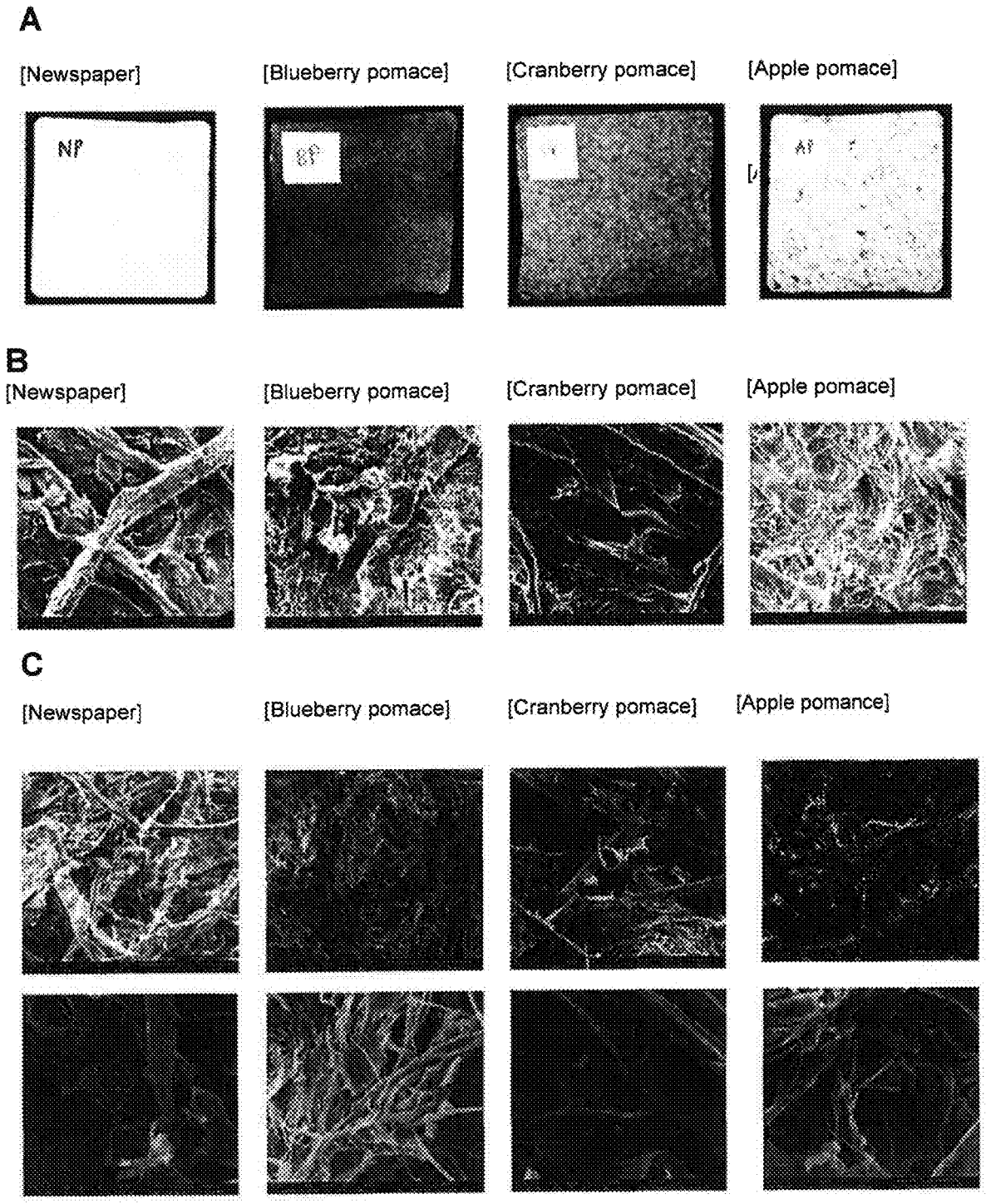
FIG. 4A illustrates color and appearance of the 100% newspaper and the three exemplary fruit pomace molded pulp boards of the invention.
FIG. 4B illustrates surface morphological properties of the 100% newspaper and the three exemplary fruit pomace molded pulp boards of the invention. The images were collected by using scanning electron microscopy (SEM) at a magnification of 100 μm with an accelerating voltage of 5-10 kV.
FIG. 4C demonstrates cross-section morphological properties of the 100% newspaper and the three exemplary fruit pomace molded pulp boards of the invention. The images were collected by using scanning electron microscopy (SEM) at a magnification 200 μm and 10 μm with an accelerating voltage of 5-10 kV.

DSC thermograms of 100% NPB and the optimized FPBs are illustrated in FIG. 3*a*. All thermograms showed a single broad endothermic peak, indicating that fiber components Morphological Property of FPBs The morphologies of 100% NPB and optimized FPBs are exhibited in FIG. 4. FIG. 4*a* shows the macroscopic images of the boards, where the boards had different colors and textures as reflected in their physicochemical properties. The skins and seeds dispersions in BPB and CPB were more uniform than in APB. FIG. 4*b* presents the surface microstructures of all boards, in which NP fibers were filled with some fragments, and 100% NP board had rougher surface compared to FPBs as NP fibers were larger than FP fibers. This rough surface created more porous in the board so that the fibers could absorb more water. This result supported the previous discussion where FPBs had lower Wa values than 100% NPB. FIG. 4*c* displays the cross-sectional microstructures of the boards, showing the external fibrillation from both NP and FP. In summary, the 100% NPB had less entanglements since it had large fibers, while more entanglements in FPBs, especially BPB, where appreciable external fibrillations filled the interfacial spaces, thus resulting in better inter-fiber bonding.

In this illustrative example, blueberry, cranberry, and apple pomace showed good performance as fiber substitutes for recycled newspapers in making molded pulp boards. Cellulosic compounds in fruit pomace were well associated with newspaper fibers through complex adhesion mechanisms. The incorporation of cellulose nanofiber significantly improved the water retention and mechanical properties of the molded pulp boards owning to its high surface area that was able to increase the bonding ability between the two types of fibers. Fine fibers from blueberry pomace had better interactions with cellulose nanofiber and newspaper fiber, while fibers from apple pomace may need to be treated chemically, biologically, or their combinations to improve the external fibrillation for better interactions with other compounds. Based on the results from this study, up to 75% of newspapers may be substituted by fruit pomace to obtain pulp board with similar functionalities to 100% newspaper board.

Comparison of properties of pulp boards prepared with apple pomace (AP) and commercial egg carton.

Different types of apple pulp (AP) board mixed with recycled newspaper (NP) and cellulose nanofiber (CNF) were prepared as described. The pulp boards were as follows 100% NP only (NP), 70% AP/30% NP (wet base) with 10% of 3% CNF slurry (A), 90% AP/10% NP (dry base) (B), 90% AP/10% NP (dry base) with 5% of 3% CNF slurry (C). Table 6 shows water absorption ability (WA, %), and water solubility (WS, %) along with weight loss (%) after the soil burial for 3 months for the exemplary boards and commercial egg carton (EC).

TABLE 6

Thickness, water absorption ability (WA, %), and water solubility (WS, %) of apple pulp (AP) board mixed with recycled newspaper (NP) and cellulose nanofiber (CNF) along with weight loss (%) after the soil burial for 3 months

| Types of boards | Thickness (mm) | WA (%) | WS (%) | Weight loss (%) |
|---|---|---|---|---|
| EC | 1.143 | 344 | 12.1 | |
| NP | 0.889 | 355 | 4.1 | |
| A* | 1.620 | 340 | 1.1 | 42.1 |
| B** | 0.946 | 256 | 20.8 | 61.1 |
| C*** | 0.495 | 261 | 21.5 | 63.3 |

+EC: commercial egg carton
++NP: 100% NP only
*A: 70% AP/30% NP (wet base) with 10% of 3% CNF slurry
**B: 90% AP/10% NP (dry base)
***C: 90% AP/10% NP (dry base) with 5% of 3% CNF slurry While one or more embodiments of the present invention have been illustrated in detail, the skilled artisan will appreciate that modifications and adaptations to those embodiments may be made without departing from the scope of the present invention as set forth in the following claims.

What is claimed is:

1. A composite molded pulp product consisting of:

fibrous fruit pomace;

fibrous paper-based material selected from the group consisting of newspaper, recycled newspaper, paperboard, recycled paperboard, cardboard, recycled cardboard, and combinations thereof;

0.0125% to 2% by weight cellulose nanofiber; and up to 5% by weight of one or more additives selected from the group consisting of hydrophobic agents, plasticizers, crosslinking agents, stabilizers, and combinations thereof;

wherein the ratio of the fibrous fruit pomace to the fibrous paper-based material is 1:1 to 20:1 by weight.

2. The composite molded pulp product of claim 1, wherein the product is selected from the group consisting of a protective packaging material, food service tray, beverage carrier, nursery pot, egg carton, end cap, tray, plate, bowl, and clamshell container.

3. The composite molded pulp product of claim 1, wherein the hydrophobic agents are selected from the group consisting of alkylketen dimer (AKD), alkenylsuccinic anhydride (ASA), rosin products, and combinations thereof.

4. The composite molded pulp product of claim 1, wherein the plasticizer is selected from the group consisting of glycerol, propylene glycol, sorbitol solutions, sorbitan monostearate, sorbitan monoleate, lactamide, acetamide DEA, lactic acid, polysorbate 20, polysorbate 60, polysorbate 80, polyoxyethylene-fatty esters and ethers, sorbitan-fatty acid esters, polyglyceryl-fatty acid esters, triacetin, dibutyl sebacate, and combinations thereof.

5. The composite molded pulp product of claim 1, wherein the crosslinking agent is selected from the group consisting of anionic crosslinking agent, cationic crosslinking agent, non-ionic crosslinking agent, and combinations thereof.

6. The composite molded pulp product of claim 1, wherein the crosslinking agent is selected from the group consisting of carboxylic acids, alginic acid, sodium alginate, carboxymethyl cellulose, pectic polysaccharides, carboxymethyl dextran, xanthan gum, carboxymethyl starch, hyaluronic acid, dextran sulfate, pentosan polysulfate, carrageenans, fuciodans, starch, chitosan, metals, proteins, cellulose derivatives, epichlorohydrin, glutaraldehyde, and combinations thereof.

7. The composite molded pulp product of claim 1, wherein the crosslinking agent functions as a stabilizer.

8. The composite molded pulp product of claim 1, wherein the composite molded product has at least one improved property as compared to a similar molded product made from 100% fibrous paper based material, wherein the at least one improved property is selected from the group consisting of water absorption, flexural strength, and flexural strain.

9. The composite molded pulp product of claim 1, wherein the fruit pomace is selected from apple pomace, cranberry pomace, blueberry pomace, and combinations thereof.

10. The composite molded pulp product of claim 1, wherein the fibrous paper-based material is cardboard or recycled cardboard.

11. The composite molded pulp product of claim 1, wherein the plasticizer is glycerol.

* * * * *